US007798945B2

(12) United States Patent
Ko

(10) Patent No.: US 7,798,945 B2
(45) Date of Patent: Sep. 21, 2010

(54) ADJUSTABLE EXERCISING DEVICE

(76) Inventor: Ming-Jen Ko, No. 92, Hsia Li Rd., Hsia Li Tsun, Hsienhsi Hsiang, Changhua Hsien (TW) 50742

( * ) Notice: Subject to any disclaimer, the term of this patent is extended or adjusted under 35 U.S.C. 154(b) by 0 days.

(21) Appl. No.: 12/502,299

(22) Filed: Jul. 14, 2009

(65) Prior Publication Data

US 2010/0069207 A1 Mar. 18, 2010

(30) Foreign Application Priority Data

Sep. 16, 2008 (TW) ..... 97216650 U

(51) Int. Cl.
*A63B 21/055* (2006.01)

(52) U.S. Cl. ..... 482/126; 482/121

(58) Field of Classification Search ..... 482/44, 482/47, 48, 91, 92, 121–126, 129, 130, 139, 482/148; 24/265 R, 300, 301, 594.11
See application file for complete search history.

(56) References Cited

U.S. PATENT DOCUMENTS 652,617 A * 6/1900 Hotz, Henry ..... 482/126
775,989 A * 11/1904 Roberts ..... 482/129
1,538,844 A * 5/1925 Titus ..... 482/139
1,539,569 A * 5/1925 Hubert ..... 482/125
3,427,023 A * 2/1969 Silberman ..... 482/139
3,460,829 A * 8/1969 Roggero ..... 482/139
3,592,467 A * 7/1971 Pereira ..... 482/126
3,636,946 A * 1/1972 Hardy ..... 601/28
3,664,667 A * 5/1972 McCarthy ..... 482/126
3,680,858 A * 8/1972 Ossenkop et al. ..... 482/126
3,873,088 A * 3/1975 Panepinto ..... 482/126
4,225,132 A * 9/1980 Archambault ..... 482/125
4,328,964 A * 5/1982 Walls ..... 482/129
5,197,934 A * 3/1993 Wirtz ..... 482/123
5,277,683 A * 1/1994 Wilkins ..... 482/129
5,665,040 A * 9/1997 Ho ..... 482/126
5,700,232 A * 12/1997 Clausen et al. ..... 482/125
6,348,026 B1 * 2/2002 Kuo ..... 482/126
6,676,576 B1 * 1/2004 Wu ..... 482/126
6,733,427 B1 * 5/2004 He ..... 482/122
7,377,886 B2 * 5/2008 Wu ..... 482/126
2007/0207904 A1 * 9/2007 Wu ..... 482/126
2009/0253562 A1 * 10/2009 Yang ..... 482/126

FOREIGN PATENT DOCUMENTS

DE 3042549 A * 6/1982

* cited by examiner

*Primary Examiner*—Loan Thanh
*Assistant Examiner*—Victor K Hwang
(74) *Attorney, Agent, or Firm*—Alan Kamrath; Kamrath & Associates PA

(57) ABSTRACT

An adjustable exercising device includes two grip members, each including a lateral coupling seat having a plurality of inserting holes disposed on a front end thereof and an engaging device mounted thereon. Each of a plurality of resilient straps has a connector fixed on each of two ends thereof. Each connector includes an engagement slot or engagement bore arranged on one side thereof, so that the connectors are inserted to the inserting holes to be retained by the engaging device.

7 Claims, 9 Drawing Sheets

ADJUSTABLE EXERCISING DEVICE

BACKGROUND OF THE INVENTION

1. Field of the Invention

The present invention relates to exercising equipment and, more particularly, to an adjustable exercising device.

2. Description of the Prior Art

As shown in FIG. 1, a conventional exercising device includes a cylinder-shaped spring 10 having two ends, each connecting with a shaft 20. The shaft 20 includes a handle 30 fitted to an outer side thereof. The handle 30 is held and compressed inward by a user to twist the spring 10. After releasing the exercising device, the spring 10 recovers its shape by using resilience, thereby exercising the user's arms and chest.

However, the conventional exercising device still has the following disadvantages:

1. The exercising device is fixed and can not be adjusted by the user based on requirement, limiting its usage.

2. While compressing the exercising device, each coil of the spring 10 will generate a gap to clamp the user dangerously.

3. The exercising device is fixed and can not decrease its size, making storing inconvenient.

The present invention has arisen to mitigate and/or obviate the afore-described disadvantages.

SUMMARY OF THE INVENTION

The primary object of the present invention is to provide an adjustable exercising device that is assembled and disassembled easily and quickly.

A further object of the present invention is to provide an adjustable exercising device that can prevent the resilient straps from injuring the user.

Another object of the present invention is to provide an adjustable exercising device in which the resilient straps and the grip members are allowed to be assembled and disassembled according to the required number and to decrease storage size.

An adjustable exercising device includes two grip members and three resilient straps. Each of the grip members includes a body, an engaging member, an elastic element, and a positioning cover. The body includes a lateral coupling seat having three inserting holes disposed on a front end thereof and a handle extending from a rear end thereof to connect with a hanging rope. The handle is filled with foam material. The coupling seat further has a sliding groove fixed on a side thereof, communicating with the inserting holes and being in response to a cross section of the engaging member to be formed in a projection shape. The coupling seat further has a retaining recess secured on an opening end of the sliding groove. The engaging member includes a pushing portion fixed on a top surface thereof, a notch arranged on an inner wall thereof, and three locking projections disposed on a bottom thereof. Each locking projection has a beveled surface mounted on a front end of one side thereof. The elastic element, such as a spring, is formed in a lamination shape. The resilient strap has a proper elasticity, and a connector is fixed on each of two ends thereof. The connector includes an engagement slot or engagement bore arranged on one side thereof.

DETAILED DESCRIPTION OF THE PREFERRED EMBODIMENTS

Figure 1:
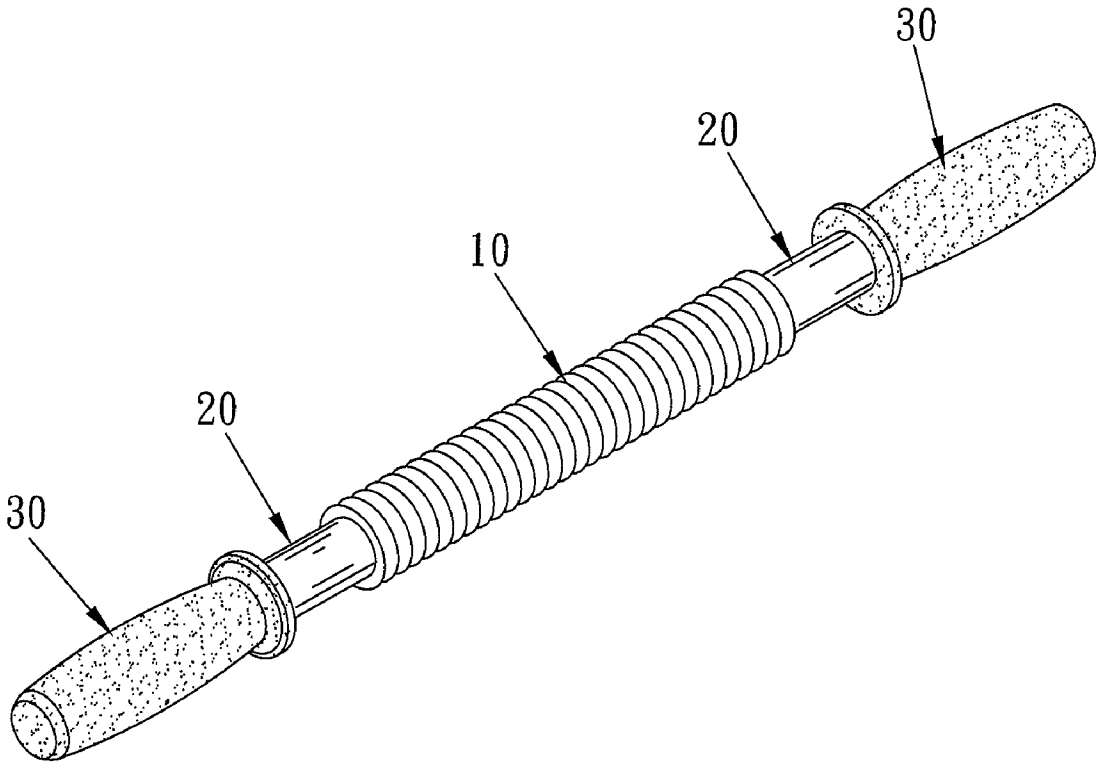
FIG. 1 Prior Art
FIG. 1 is a perspective view of a conventional adjustable exercising device.
Figure 2:
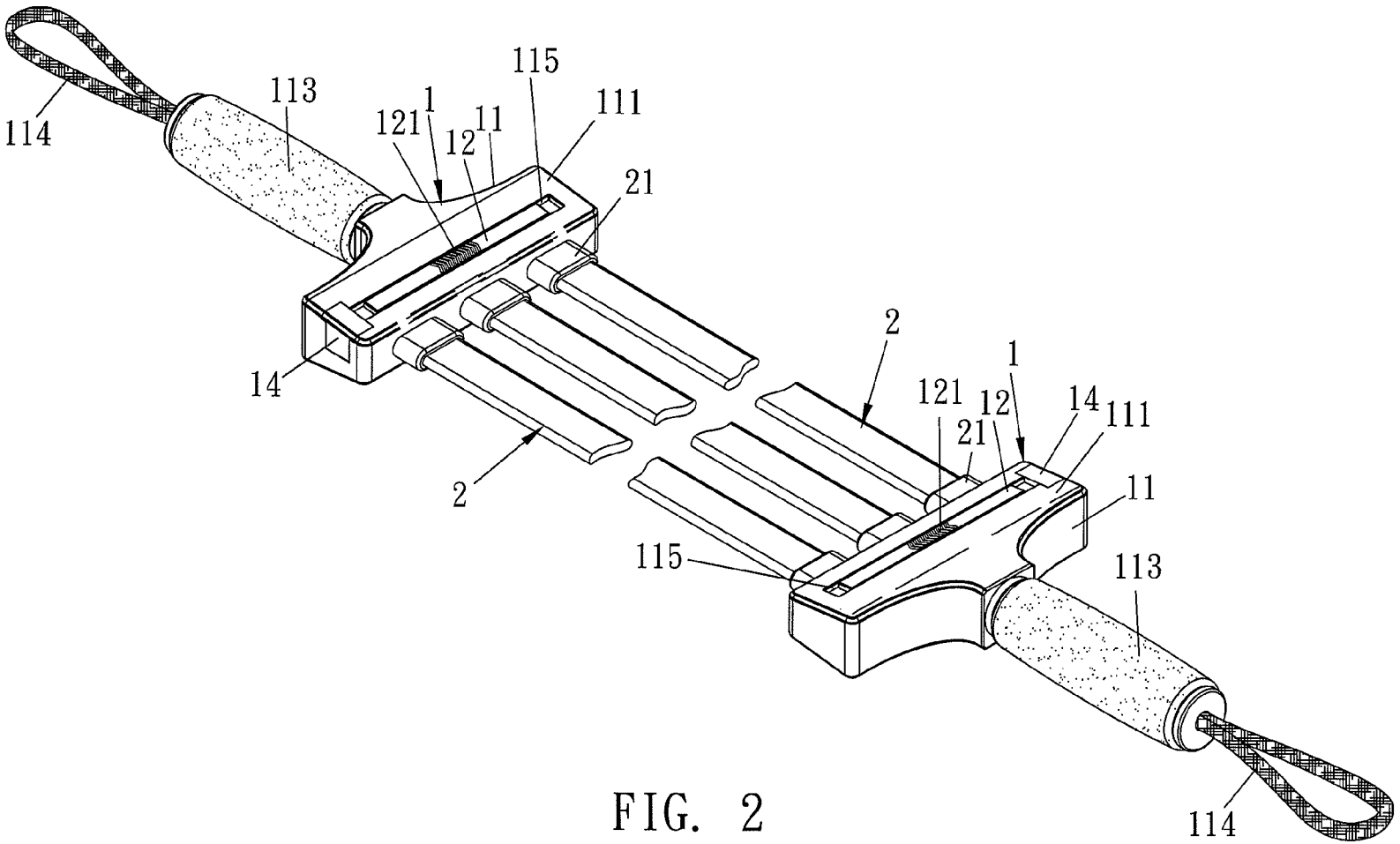
FIG. 2 is a perspective view showing the assembly of an adjustable exercising device in accordance with a preferred embodiment of the present invention.
Figure 3:
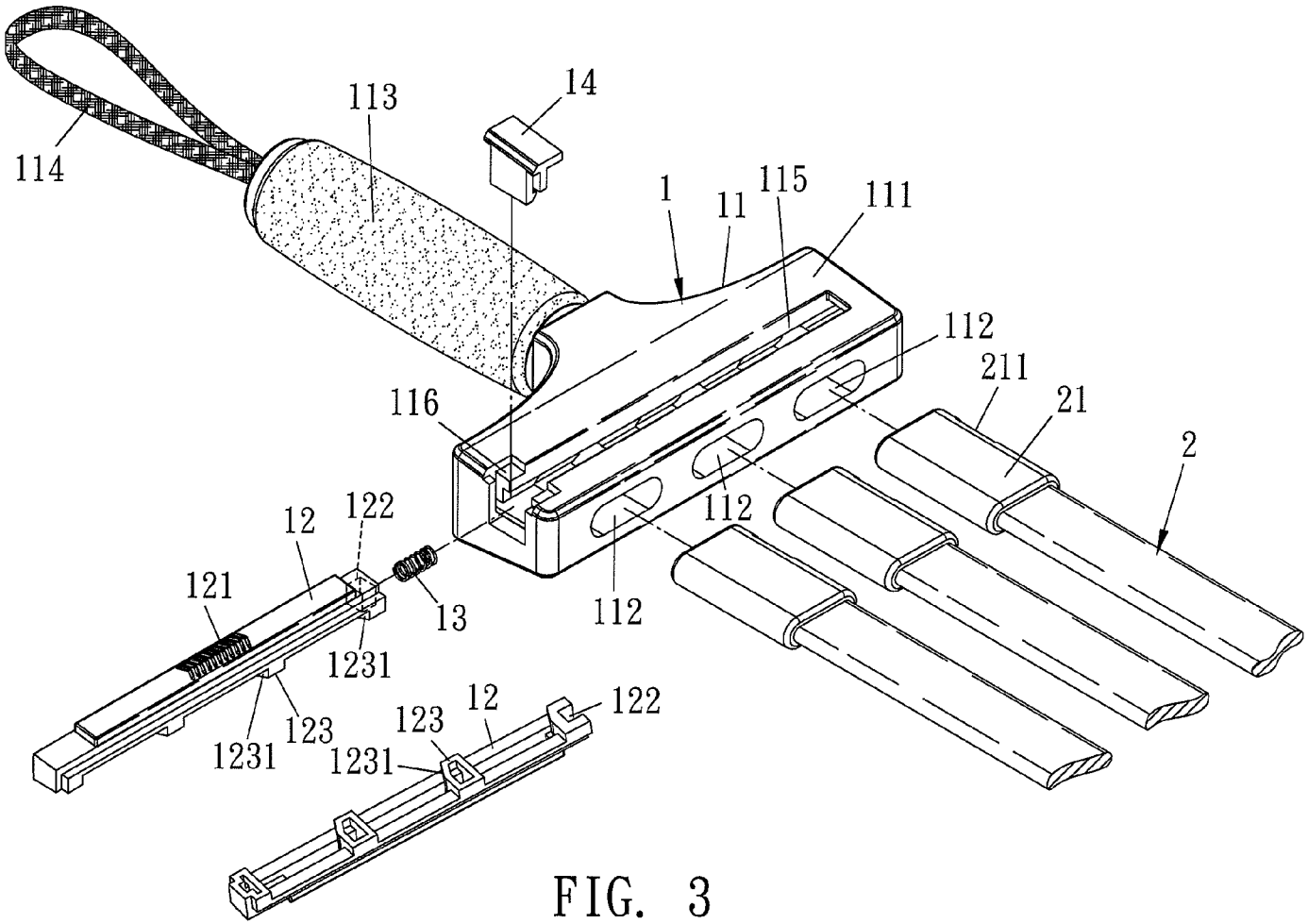
FIG. 3 is a partial perspective view showing the exploded components of the adjustable exercising device in accordance with the preferred embodiment of the present invention.
Figure 4:
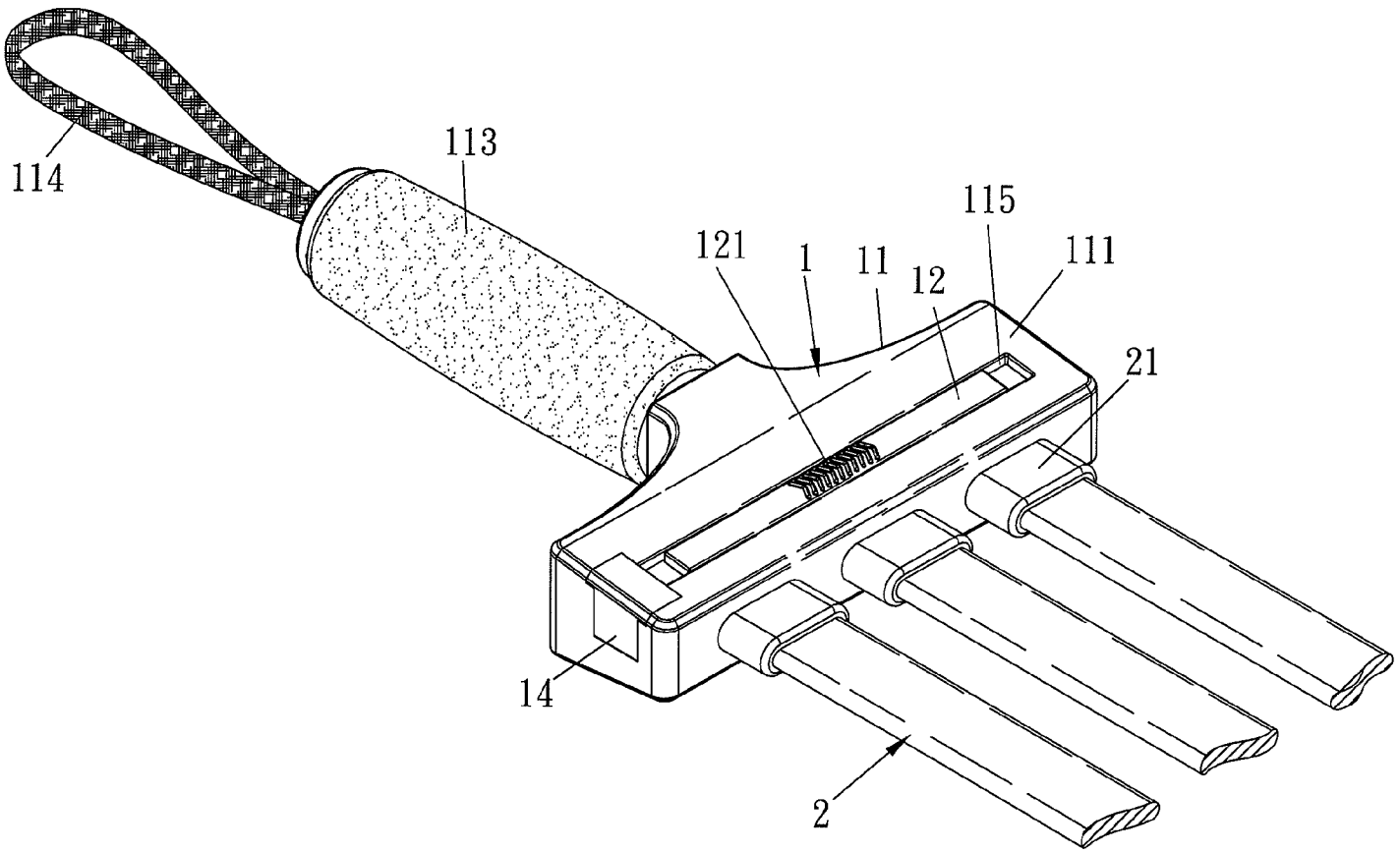
FIG. 4 is a partial perspective view showing the assembly of the adjustable exercising device in accordance with the preferred embodiment of the present invention.
Figure 5:
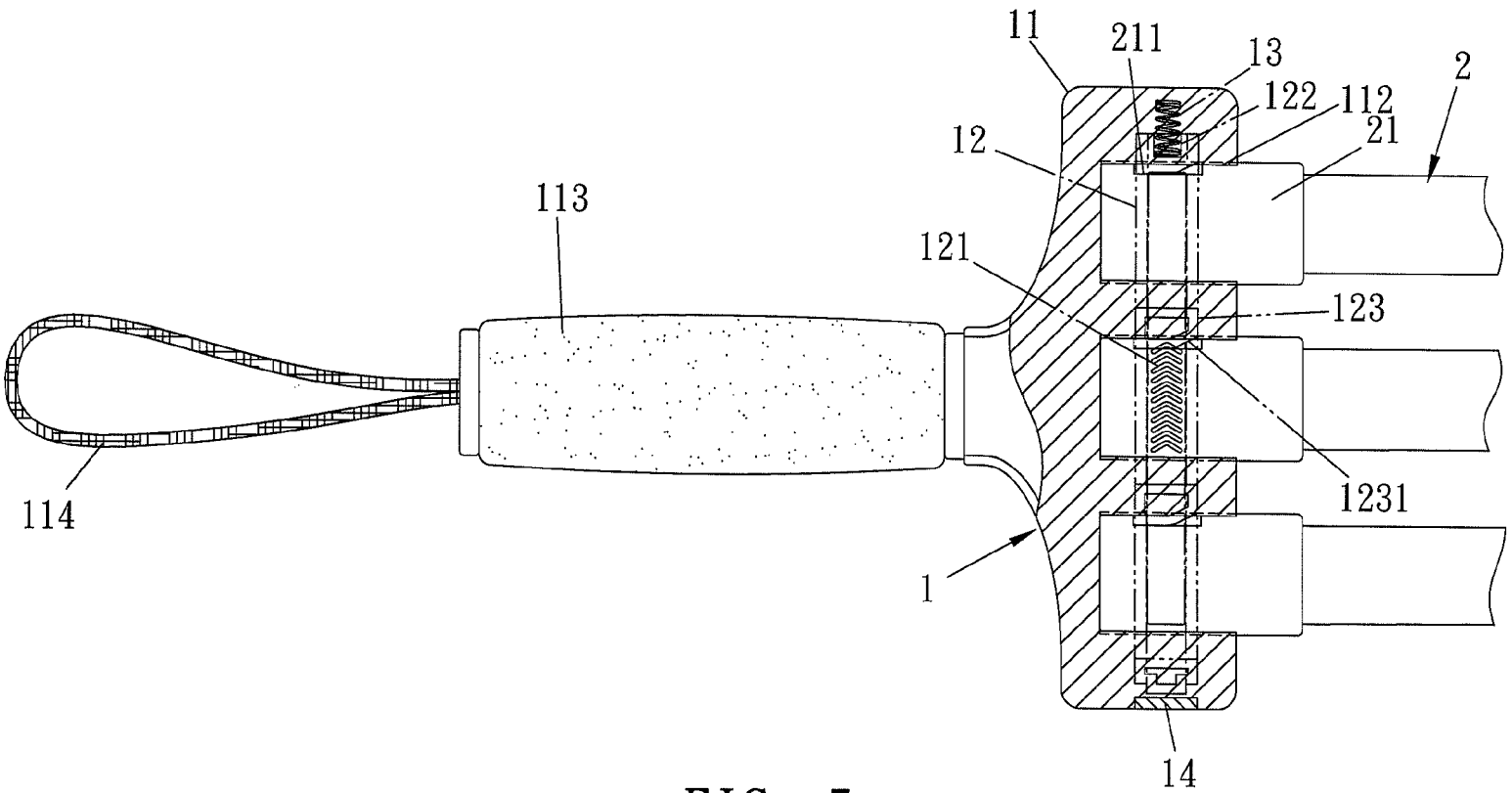
FIG. 5 is a partial cross sectional view showing the assembly of the adjustable exercising device in accordance with the preferred embodiment of the present invention.
Figure 6:
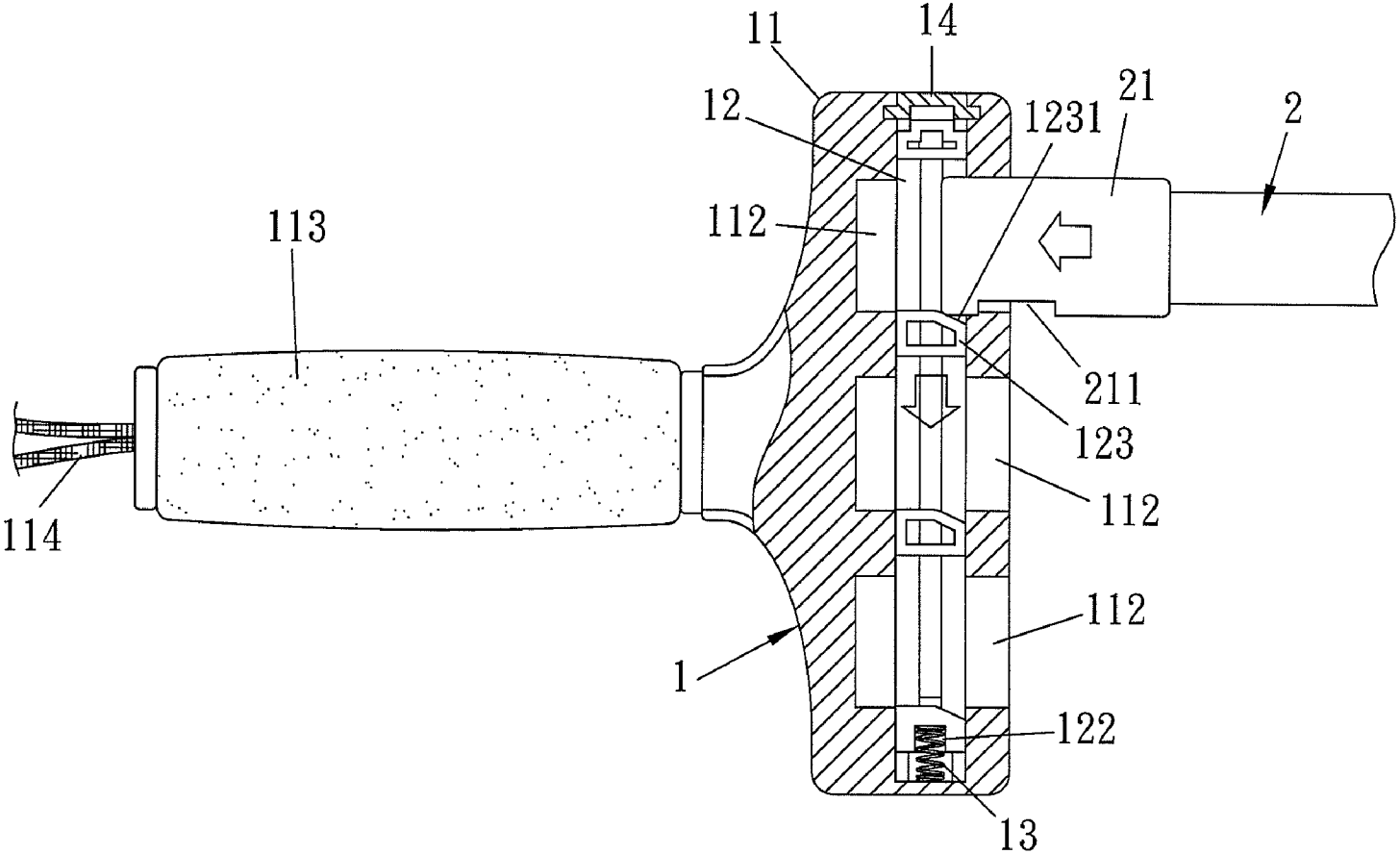
FIG. 6 is a partial cross sectional view showing a resilient strap being assembled to a grip member.

The present invention will be clearer from the following description when viewed together with the accompanying drawings, which show, for purpose of illustration only, the preferred embodiments in accordance with the present invention.

Referring to FIGS. 2-6, an adjustable exercising device comprises two grip members 1 and three resilient straps 2. Each of the grip members 1 includes a body 11, an engaging member 12, an elastic element 13, and a positioning cover 14. The body 11 includes a lateral coupling seat 111 having three inserting holes 112 disposed on a front end thereof and a handle 113 extending from a rear end thereof to connect with a hanging rope 114. The handle 113 is filled with foam material. The coupling seat 111 further has a sliding groove 115 fixed on a side thereof, communicating with the inserting holes 112 and being in response to a cross section of the engaging member 12 to be formed in a projection shape. The coupling seat 111 further has a retaining recess 116 secured on an opening end of the sliding groove 115. The engaging member 12 includes a pushing portion 121 fixed on a top surface thereof, a notch 122 arranged on an inner wall thereof and three locking projections 123 disposed on a bottom thereof. Each locking projection 123 has a beveled surface 1231 mounted on a front end of one side thereof. The elastic element 13, such as a spring, is formed in a lamination shape. The resilient strap 2 has a proper elasticity, and a connector 21 is fixed on each of two ends thereof. Each connector 21 includes an engagement slot 211 or engagement bore arranged on one side thereof.

In assembly, one end of the elastic element 13 is fitted into the notch 122 of the engaging member 12. Then, the elastic element 13 and the engaging member 12 are fitted to the sliding groove 115 of the body 11. The positioning cover 14 covers the retaining recess 116 of the body 11 to limit the engaging member 12 to not disengage from the sliding groove 115 of the body 11. The elastic element 13 is pressed to abut against an inner side of the notch 122 of the engaging member 12 by using its one end, and another end of the elastic element 13 is biased against an inner side of the sliding groove 115. Then, the connectors 21 of the two ends of the resilient strap 2 are inserted to the inserting holes 112 to push against the beveled surface 1231 of the locking projection 123 of the engaging member 12. The elastic element 13 is compressed to drive the engaging member 12 to slide horizontally. As the connectors 21 are inserted to predetermined positions, the engaging member 12 is pushed by the elastic element 13 to move back to its original position. The locking projection 123 is retained in the engagement slot 211 of the connector 21, finishing assembly.

In operation, the two grip members 1 are held by the user to be pressed inward to twist the resilient straps 2. After the user releases the resilient straps 2, the resilient straps 2 recover their resilience to exercise the user's arms and chest.

Figure 7:
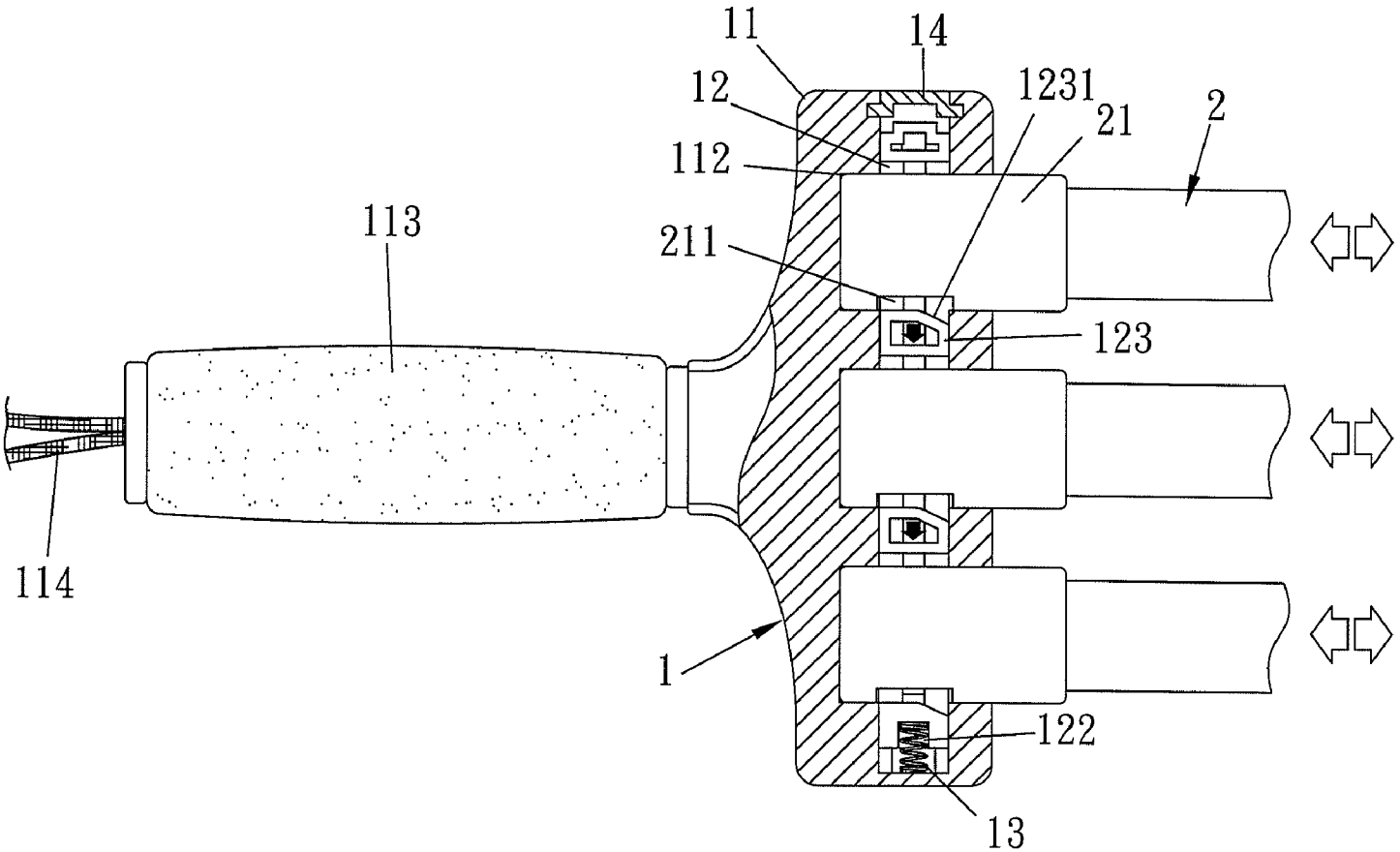
FIG. 7 is a partial cross sectional view showing the resilient strap being disassembled from a grip member.

As shown in FIG. 7, when desiring to remove the resilient straps 2, the engaging member 12 is pushed away from the sliding groove 15 by pushing the pushing portion 121 so that the elastic element 13 compresses the locking projections 123 of the engaging member 12 to disengage from the engagement slots 211 of the connectors 21 of the resilient straps 2. Then, the connectors 21 of the resilient straps 2 are pulled away from the inserting holes 112 of the body 11.

Figure 8:
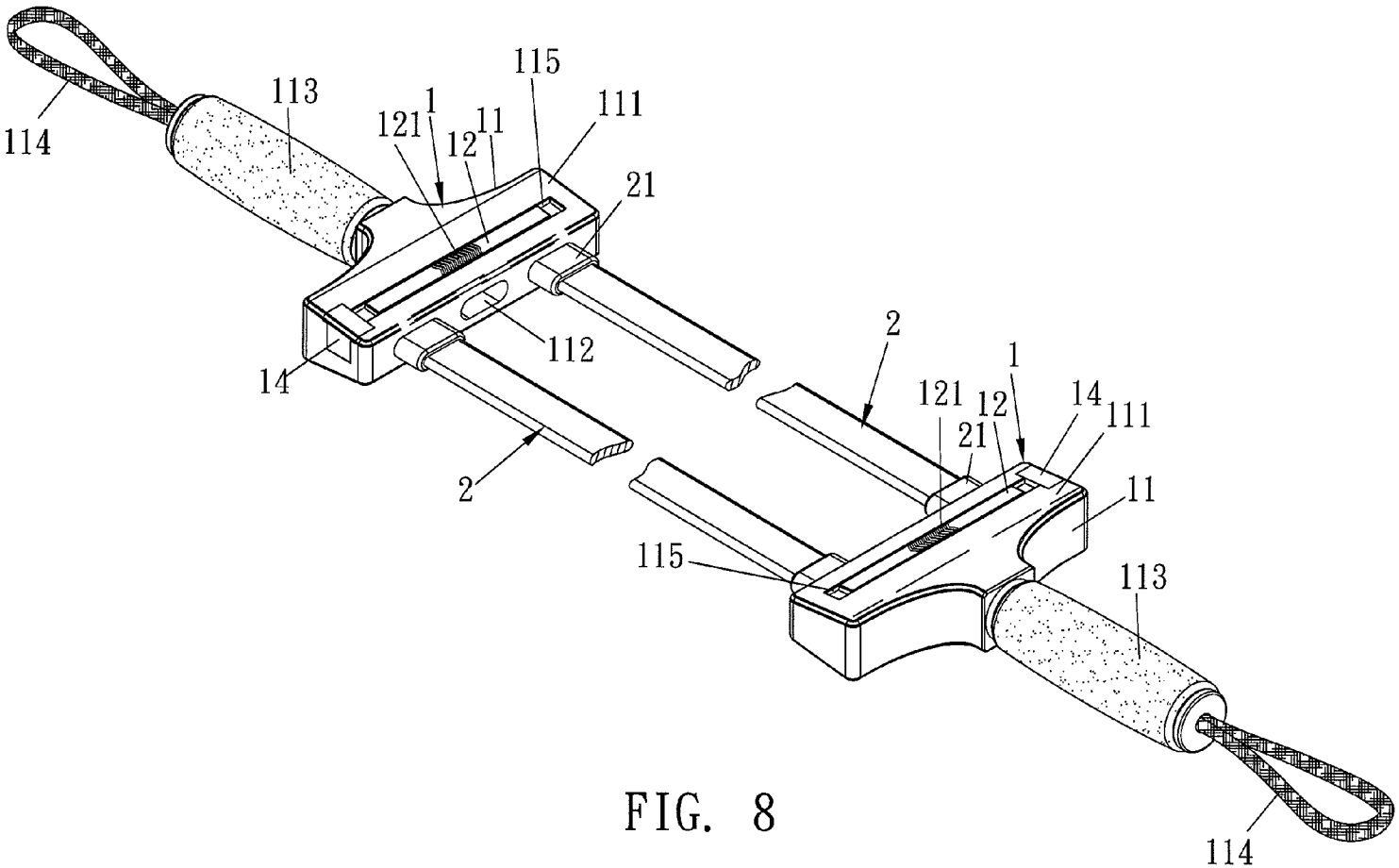
FIG. 8 is a perspective view showing the operation of the adjustable exercising device in accordance with the preferred embodiment of the present invention.
Figure 9:
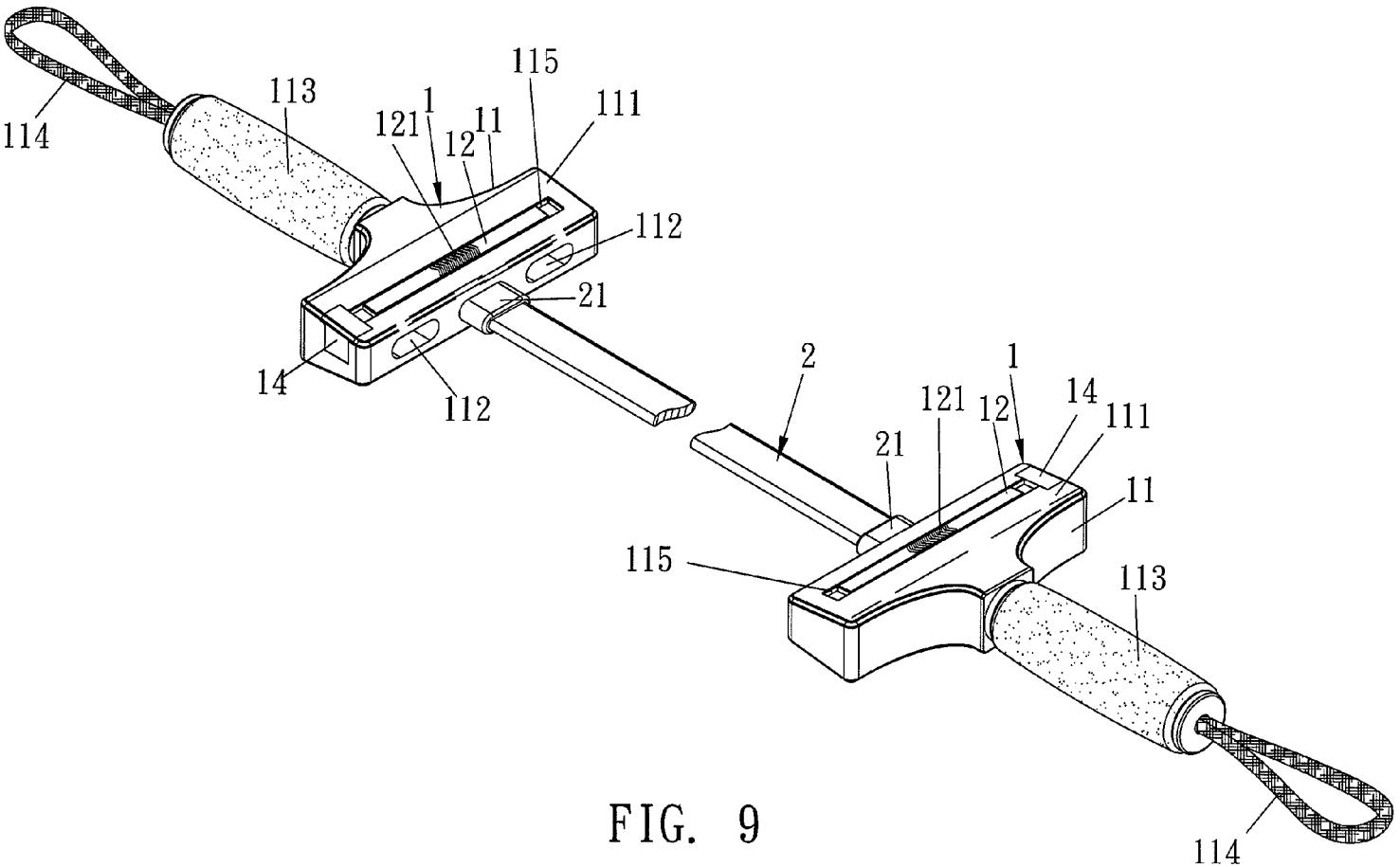
FIG. 9 is another perspective view showing the operation of the adjustable exercising device in accordance with the preferred embodiment of the present invention.

Referring to FIGS. 8 and 9, one or two resilient straps 2 are selected to be inserted to the inserting holes 112 located on two outer sides of the coupling seats 111 or the inserting holes 112 located on a middle portion thereof.

It is apparent from the above description that the adjustable exercising device of the present invention has the following advantages:

1. The number of the resilient straps 2 is selective based on requirement to assemble and disassemble from the predetermined inserting holes 112 easily, adjusting desired resiliently twisted resistance.

2. In assembly, the resilient straps 2 are inserted to the inserting holes 112 directly. Also, by pushing the engaging member 12 outward, the resilient straps 2 are disassembled quickly.

3. The resilient straps 2 are located between the handles 1, preventing the resilient straps 2 from injuring the user.

4. The resilient straps 2 and the grip members 1 allow to be assembled and disassembled according to required number to decrease storage size.

While various embodiments have been shown and described in accordance with the present invention, it is clear to those skilled in the art that further embodiments may be made without departing from the scope of the present invention.

What is claimed is:

1. An adjustable exercising device comprising:

two grip members each including a lateral coupling seat having a plurality of inserting holes disposed on a front end thereof and an engaging device mounted thereon; and a plurality of resilient straps each having a connector fixed on each of two ends thereof, with each connector including an engagement slot or engagement bore arranged on one side thereof so that the connectors are inserted into respective inserting holes to be retained by the engaging device, wherein the coupling seat of the grip member further includes a sliding groove fixed on a side thereof and communicating with the inserting holes, and wherein the sliding groove includes an engaging member fixed therein and having a number of locking projections arranged on a bottom surface of the engaging member.

2. The adjustable exercising device as claimed in claim 1, wherein the sliding groove is in response to a cross section of the engaging member to be formed in a projection shape.

3. The adjustable exercising device as claimed in claim 1, wherein the resilient strap is formed in a lamination shape.

4. An adjustable exercising device comprising:

two grip members each including a lateral coupling seat having a plurality of inserting holes disposed on a front end thereof and an engaging device mounted thereon; and a plurality of resilient straps each having a connector fixed on each of two ends thereof, with each connector including an engagement slot or engagement bore arranged on one side thereof so that the connectors are inserted into respective inserting holes to be retained by the engaging device, wherein each of the grip members includes a body, the engaging member, an elastic element, and a positioning cover, wherein the body includes the lateral coupling seat with the coupling seat further having a sliding groove fixed on a side thereof and communicating with the plurality of inserting holes, with the coupling seat having a retaining recess secured on an opening end of the sliding groove, wherein the engaging member is fixed in the sliding groove of the body and includes a pushing portion fixed on a top surface thereof and a notch arranged on an inner wall thereof to be abutted by the elastic element, wherein another end of the elastic element is biased against an inner side of the sliding groove, wherein the engaging member includes a number of locking projections disposed on a bottom thereof, and wherein the positioning cover covers the retaining recess of the body to limit the engaging member to not disengage from the sliding groove of the body.

5. The adjustable exercising device as claimed in claim 4, wherein the coupling seat of the body includes a handle extending from a rear end thereof.

6. The adjustable exercising device as claimed in claim 4, wherein each locking projection has a beveled surface mounted on a front end of one side thereof.

7. The adjustable exercising device as claimed in claim 4, wherein the resilient strap is formed in a lamination shape.

* * * * *